US007971535B1

(12) United States Patent
Kim et al.

(10) Patent No.: US 7,971,535 B1
(45) Date of Patent: Jul. 5, 2011

(54) HIGH-LETHALITY LOW COLLATERAL DAMAGE FRAGMENTATION WARHEAD

(75) Inventors: Henri Y. Kim, Tucson, AZ (US); Travis Walter, Tucson, AZ (US); Kim L. Christianson, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 343 days.

(21) Appl. No.: 12/123,158

(22) Filed: May 19, 2008

(51) Int. Cl.
*F42B 12/22* (2006.01)

(52) U.S. Cl. ..... 102/494; 102/475

(58) Field of Classification Search ..... 102/492, 102/494, 475, 506, 515, 389, 495
See application file for complete search history.

(56) References Cited

U.S. PATENT DOCUMENTS

| | | | | | |
|---|---|---|---|---|---|
| 3,570,401 | A * | 3/1971 | Euker | 102/363 |
| 3,646,888 | A | 3/1972 | Posson et al. | |
| 3,750,587 | A | 8/1973 | Walde | |
| 3,785,293 | A * | 1/1974 | Barr et al. | 102/529 |
| 3,818,833 | A | 6/1974 | Throner | |
| 3,877,383 | A * | 4/1975 | Flatau | 102/503 |
| 3,968,748 | A * | 7/1976 | Burford et al. | 102/394 |
| 3,970,005 | A | 7/1976 | Rothman | |
| 3,977,327 | A | 8/1976 | Brumfield et al. | |
| 3,978,796 | A | 9/1976 | Hackman | |
| 4,106,411 | A * | 8/1978 | Borcher et al. | 102/495 |
| 4,463,678 | A * | 8/1984 | Weimer et al. | 102/307 |
| H540 | H | 11/1988 | Caprioni | |
| 4,882,996 | A | 11/1989 | Bock et al. | |
| H1011 | H | 1/1992 | Kline | |
| 5,090,324 | A | 2/1992 | Boecker et al. | |
| 5,157,225 | A | 10/1992 | Adams et al. | |
| 5,313,890 | A * | 5/1994 | Cuadros | 102/496 |
| 5,320,044 | A * | 6/1994 | Walters | 102/475 |
| 5,323,707 | A * | 6/1994 | Norton et al. | 102/431 |
| 5,337,673 | A | 8/1994 | Koontz et al. | |
| 5,419,024 | A | 5/1995 | Koontz et al. | |
| 5,544,589 | A | 8/1996 | Held | |
| 5,668,346 | A | 9/1997 | Kunz et al. | |
| 6,484,642 | B1 | 11/2002 | Kuhns et al. | |
| 6,758,143 | B2 * | 7/2004 | Ritman et al. | 102/476 |
| 7,004,075 | B2 * | 2/2006 | Ronn et al. | 102/473 |
| 2006/0266247 | A1 * | 11/2006 | Gilliam et al. | 102/475 |

* cited by examiner

*Primary Examiner* — Bret Hayes
*Assistant Examiner* — Reginald Tillman, Jr.
(74) *Attorney, Agent, or Firm* — Eric A. Gifford

(57) ABSTRACT

The present invention provides a high-lethality low collateral damage fragmentation warhead. The case is formed of a material that is pulverized upon detonation of the explosive. As a result, the lethality radius of the pulverized case fragments is no greater than that of the gas blast, thus reducing potential collateral damage. Warhead lethality is improved by placing a pattern shaper between the fragment assembly and the explosive. The explosive and pattern shaper have a conformal non-planar interface that shapes the pressure wavefront as it propagates there through to expel metal fragments from the fragmentation assembly with a desired pattern density over a prescribed solid angle.

22 Claims, 9 Drawing Sheets

90
48
38

90

90

90
TIME T1
92
38

TIME T2
92

TIME T3
92

TIME T4
92

HIGH-LETHALITY LOW COLLATERAL DAMAGE FRAGMENTATION WARHEAD

BACKGROUND OF THE INVENTION

1. Field of the Invention

This invention relates to fragmentation warheads.

2. Description of the Related Art

Fragmentation warheads expel metal fragments upon detonation of an explosive. Fragmentation warheads are used as offensive weapons or as countermeasures to anti-personnel or anti-property weapons such as rocket-propelled grenades. A typical warhead includes an explosive inside a steel case. A booster explosive and safe and arm device are positioned in an aft section of the case to detonate the explosive. A fragmentation assembly is placed in an opening in a fore section of the case against the flat leading surface of the explosive. The fragmentation assembly will typically include 'scored' metal or individual fragments such as spheres or cubes to control the size and shape of the fragments so that the fragments are expelled in a predictable pattern and speed. Scored metal produces about an 80% mass efficiency while individual fragments are expelled with mass efficiency approaching 100% where mass efficiency is defined as the ratio of fragment mass expelled (therefore effective against the intended target) to the total fragment mass. In other words, the mass efficiency is the ratio of the total mass less the interstitial mass that was consumed during the launch process (therefore ineffective against the intended target) to the total mass.

The steel case confines a portion of the radial energy of the pressure wave (albeit for a very short duration) caused by detonation of the explosive and redirects it along the body axis of the warhead to increase the force of the blast that propels the metal fragments forward with a lethality radius of, for example, 25-50 meters. The lethality radius is defined as the radius of a virtual circle composed of the sum of all lethal areas (zones) meeting a minimum lethal threshold. For example, the lethality threshold may occur when 1% of people at that radius are killed. These fragments are generally expelled in a forward cone towards the intended target. The density of fragments per unit area is maximum near zero degrees and falls off with increasing angle with tails that extend well beyond the desired cone. As a result, the warhead has a maximum lethality confined to a very narrow angle and expels a certain amount of lethal fragments outside the desired target area that may cause collateral damage. As a result, the aimpoint and detonation timing tolerances to engage and destroy the threat while minimizing collateral damage are tight.

Detonation of the high explosive produces a gas blast that has a much smaller lethality radius, maybe 3 meters in this example, in all directions caused by the pressure wave of the blast. The detonation also tears the steel case into metal fragments of various shapes and sizes that are thrown in all directions, beyond the lethality radius of the gas blast. In this example, the expelled metal fragments from the case may have a lethality radius of 5-8 meters. Detonation of the steel case increases the potential for collateral damage without improving the lethality of the warhead to destroy the threat.

SUMMARY OF THE INVENTION

The present invention provides a high-lethality low collateral damage fragmentation warhead.

This is accomplished by forming the case of a material that is pulverized upon detonation of the explosive. The lethality radius of the pulverized case fragments is no greater than that of the gas blast, thus reducing potential collateral damage. Warhead lethality is improved by placing a pattern shaper between the fragment assembly and the explosive. The explosive and pattern shaper have a conformal non-planar interface that shapes the front of the pressure wave as it propagates there through to expel metal fragments from the fragmentation assembly with a desired pattern density over a prescribed solid angle. In an exemplary embodiment, the pattern shaper provides a more uniform density over only the prescribed solid angle. This improves lethality and further reduces collateral damage. The expelled metal fragments exhibit a mass efficiency of at least 70% with typical values of approximately 80% for scored metal and near 100% for discrete fragments such as cubes or spheres. By comparison the pulverized case fragments exhibit a mass efficiency of no more than 1% with preferred values near 0%. A metal retaining ring around the periphery of and at least coextensive with the fragmentation assembly provides a measure of confinement that directs fragments at the edges in the desired direction to reduce any tails outside the prescribed solid angle. The warhead may be configured as forward or side-firing. Although the preferred embodiment includes both the case material that is pulverized upon detonation and the pattern shaper, the fragmentation warhead may be improved by employing either feature alone to reduce collateral damage or improve lethality.

In an exemplary embodiment of a forward firing warhead, the case is made of a material that is pulverized with a mass efficiency near 0% upon detonation. Detonation is initiated with a single-point booster positioned aft along the body axis aft of the explosive. The fore end of the explosive and the pattern shaper are designed to progressively slow the advancing pressure wave with increasing radius from the body axis to make the number of expelled fragments per unit area more uniform across a prescribed solid angle. This is achieved by providing the explosive with a convex conical shape about the body axis having radius R1 and slope S1. The explosive and pattern shaper are also designed (suitably in conjunction with the retaining ring) to gradually speed the advancing pressure wavefront at the periphery to direct expelled fragments along the body axis to reduce the tails outside the prescribed solid angle. This is achieved by providing the explosive with a convex annular shape from radius R2 to the other edge with slope S2. The two shaped regions are typically separated by a planar annular region of R2-R1. The interior surface of the pattern shaper conforms to the shape of the explosive. The exterior surface is typically planar and abuts the fragment assembly. The thickness of the pattern shaper is dictated by the shock impedance of the material from which it is formed. The pattern shaper can be an integral part of the fragmentation assembly. However, discrete parts simplify machining and allows for more flexibility in the selection of the pattern shaper material.

These and other features and advantages of the invention will be apparent to those skilled in the art from the following detailed description of preferred embodiments, taken together with the accompanying drawings, in which:

DETAILED DESCRIPTION OF THE INVENTION

The present invention provides a high-lethality low collateral damage fragmentation warhead. This is accomplished by forming the case of a material that is pulverized upon detonation of the explosive. As a result, the lethality radius of the pulverized case fragments is no greater than that of the gas blast, thus reducing potential collateral damage. Warhead lethality is improved by placing a pattern shaper between the fragment assembly and the explosive. The explosive and pattern shaper have a conformal non-planar interface that shapes the pressure wavefront caused by detonation of the explosive as it propagates there through to expel metal fragments from the fragmentation assembly with a desired pattern density over a prescribed solid angle.

The fragmentation warhead can be used in conjunction with a wide range of interceptors including projectiles and self-propelled missiles and spinning or non-spinning and various guidance systems. The aiming and detonation sequence may be computed and loaded into the interceptor prior to firing. For example, in a close-range countermeasure system, the guidance system will determine when to fire a sequence of motors on the interceptor and when to detonate the warhead. This sequence is loaded into the interceptor prior to launch. A more sophisticated longer range missile might fly to a target and compute its own aiming and detonation sequences or have those sequences downloaded during flight.

Figure 1:
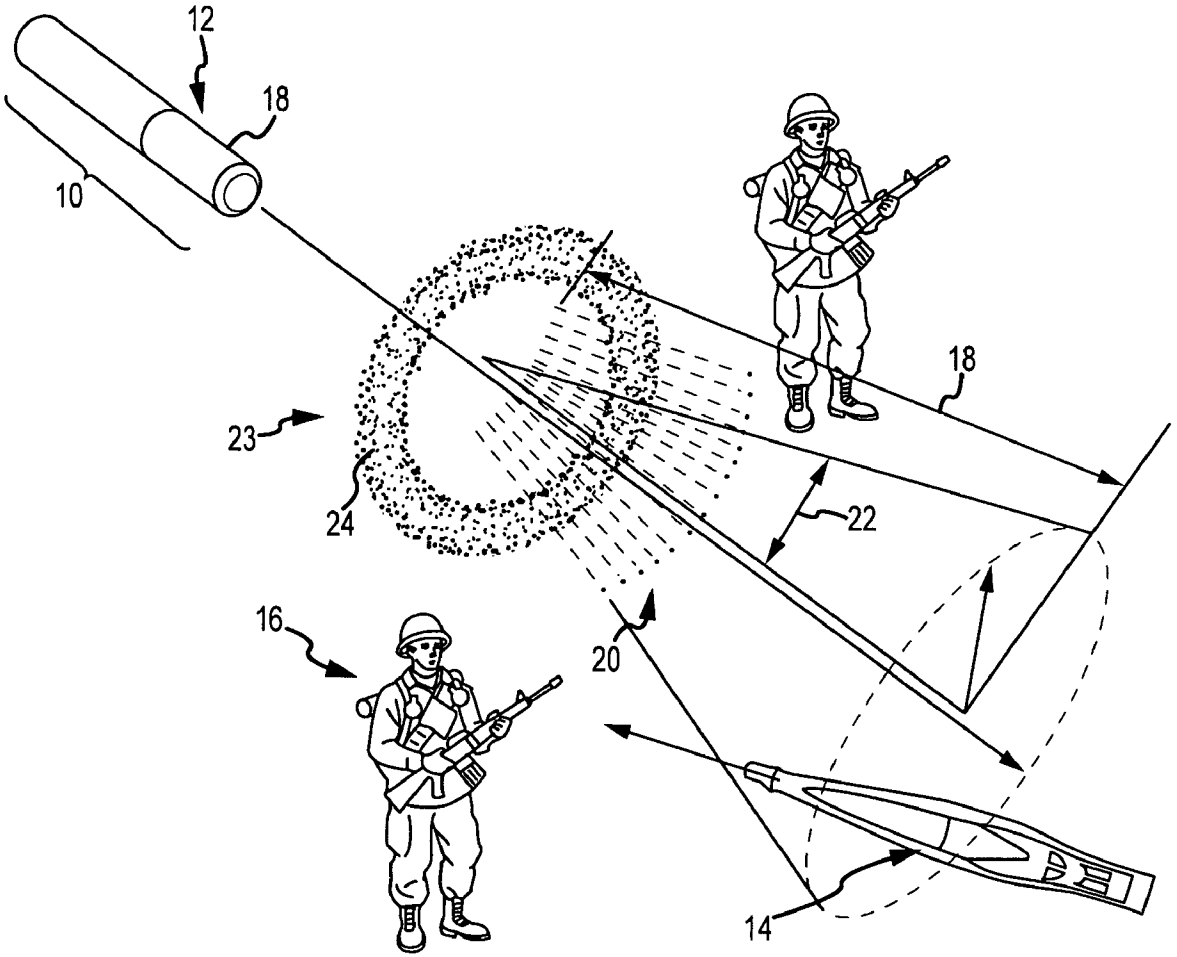
FIG. 1 is a diagram illustrating the use of the high lethality low collateral damage warhead in accordance with the present invention.

As shown in FIG. 1 of an exemplary countermeasures system, an interceptor 10 including a fragmentation warhead 12 is fired to engage and destroy a threat depicted as a rocket-propelled grenade 14 in close proximity to friendly troops 16. The warhead must destroy the threat with a high likelihood of success and minimize the threat of collateral damage to the troops or, more generally, to any person or object other than the engaged threat. The aiming and detonation sequence are loaded into the interceptor and is fired at threat 14. The warhead is detonated at a standoff distance 18 to expel metal fragments 20 in a prescribed half-angle 22 to destroy the threat.

The threat detection, guidance, navigation and control systems generate a firing solution to destroy the threat. That solution has a composite system error which means there is an aiming error that can be translated into an area or volume. The area or volume of the cone is typically 100 to 1,000 times larger than the presented area of the target. The fragmentation warhead must engage the entire area or volume with lethal force to destroy the threat. The area or volume and the lethality requirement per threat determine the number of fragments that must be expelled. Typically the threat can be in any place within the volume with equal probability. In this case, the fragmentation warhead is suitably designed to expel metal fragments having an approximately uniform pattern density (# fragments per unit area) over the prescribed solid angle of the volume and preferably no further. If the threat is not placed in the volume with equal probability but is skewed in some manner, the fragmentation warhead is suitably designed to match that distribution.

To accomplish the dual objectives of improved lethality and reduced collateral damage, the case 18 is formed of a material such as a fiber reinforced composite, engineered wood, thermoplastic (resin, polymer), or even foam that is pulverized into a cloud 23 of harmless fine particles 24 upon detonation of the explosive. The particles preferably have a mass efficiency near 0% and no greater than 1% so that the lethality radius of the expelled particles 24 is no greater than the lethality radius of the gas blast from the detonating explosives. Consequently, the threat to the soldiers on either side of the warhead is reduced to the threat posed by the gas blast. For typical countermeasure sized warheads this is a couple meters.

A pattern shaper is placed inside the case between the fragmentation assembly and the explosive. The explosive and pattern shaper have a conformal non-planar interface that shapes the pressure wavefront as it propagates there through to expel metal fragments 20 from the fragmentation assembly with a desired pattern density over the prescribed solid angle 22. In the typical scenario, the pattern shaper produces an approximately uniform density of fragments per unit area over the cone. The pattern shaper and explosive (suitably in conjunction with a metal retaining ring) are also designed to reduce or eliminate the tails of expelled fragments beyond the desired cone to further reduce collateral damage.

Figure 2:
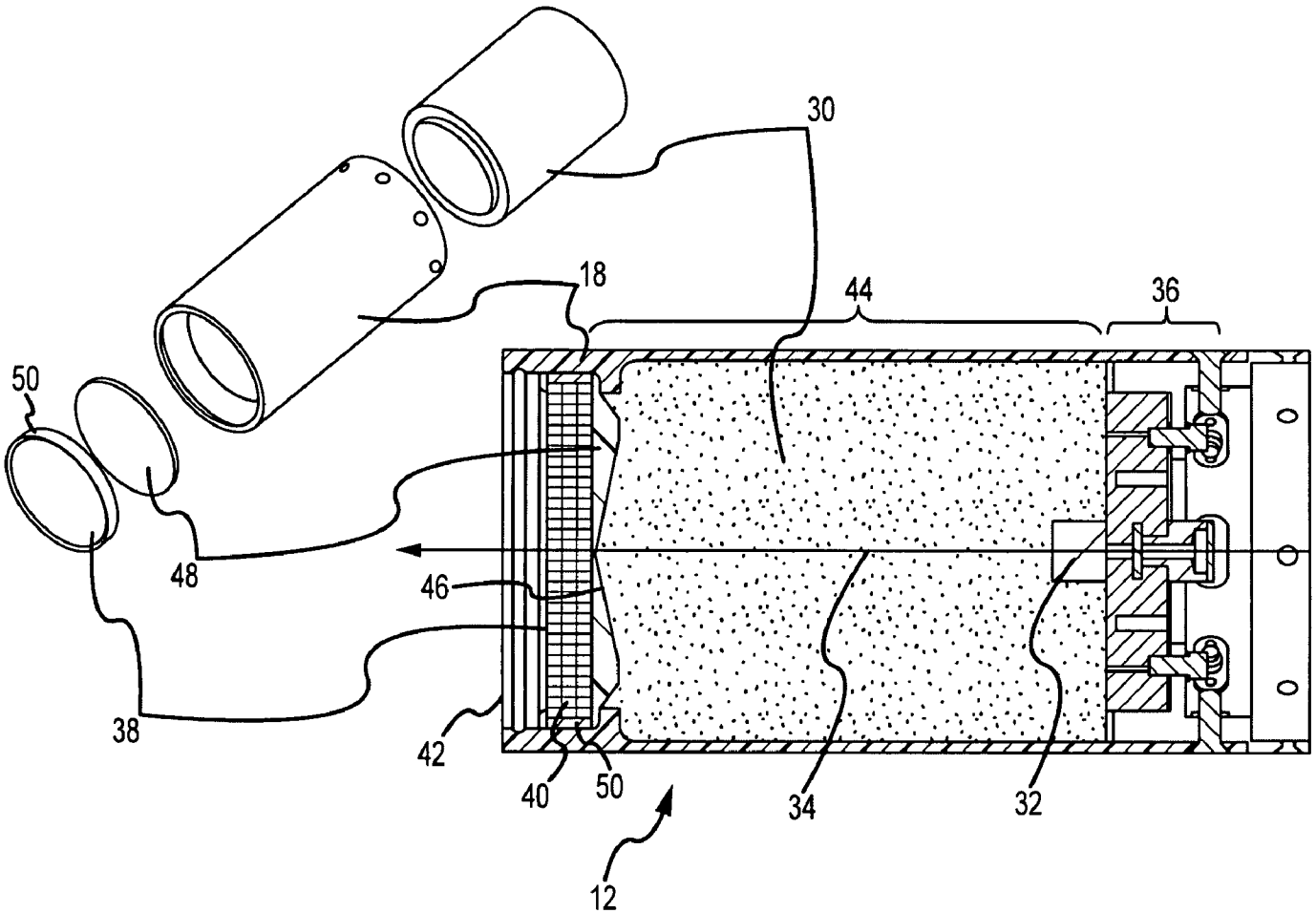
FIG. 2 is a diagram of a section and exploded view of the warhead including a case that is pulverized upon detonation to reduce collateral damage and a pattern shaper that shapes the pattern density of expelled fragments to improve lethality.

An exemplary embodiment of forward-firing fragmentation warhead 12 configured for use as a countermeasure to expel metal fragments with an approximately uniform density over only a prescribed solid angle is shown in FIG. 2. An explosive 30 is placed inside case 18. A small booster charge 32 is placed on the body axis 34 aft of explosive 30. This type of single-point detonation is typical for these types of warheads. Other multi-point configurations may be used. A safe and arm device 36 is positioned to ignite the booster when commanded. A fragmentation assembly 38 is placed inside the case fore of explosive 30. The assembly may be scored metal or discrete pre-formed fragments 40 such as spheres or cubes. The pre-formed fragments are generally preferred because they have a known size and shape upon detonation and retain a mass efficiency near 100%. For ease of assembly the fragments are typically held in a cup (not shown) that is pulverized on detonation. A layer 42 such as RTV holds the assembly in place. A nose cone (not shown) is positioned on the front of the warhead.

For a given design the space between the safe and arm device 36 and fragmentation assembly 38 defines a volume 44 for explosive. The conventional approach is to fill the entire volume 44 with explosive to maximize the force of the gas blast. Furthermore case 30 is formed from steel that at least partially confines the gas blast to expel fragments forward generally along body axis 34. This maximizes the lethality radius of the expelled fragments and presumably the overall lethality of the warhead.

The warhead design of the present invention takes a different approach countering conventional design philosophy to improve overall lethality while reducing the risk of collateral damage. First, case 18 is formed of a material such as fiber reinforced composite, engineered wood, thermoplastic (resin, polymer), or even foam that is pulverized upon detonation of explosive 30. This eliminates the metal fragments thrown radially from the detonating warhead at the cost of losing the confinement provided by the steel case. Second, explosive material is removed from the fore surface 46 of explosive 30 and a pattern shaper 48 conformal with the shaped fore surface is placed in the case to fill the missing volume. The interface between the explosive and the pattern shaper changes the relative velocities of a propagating pressure wave across an aft surface of the fragmentation assembly 38 to shape the pattern density of expelled metal fragments. The conformal shape and thickness of the pattern shaper are determined by a number of design parameters including the detonation scheme, the material used for the pattern shaper, the design of the fragmentation assembly, the prescribed solid angle and the desired pattern density over the solid angle. A metal retaining ring 50 is preferably placed around the periphery and at least coextensive with fragmentation assembly 38. This ring provides a degree of confinement to direct fragments axially instead of radially. The ring contributes to reducing or eliminating the tails of the pattern density beyond the prescribed solid angle. Although some volume of explosive material and confinement are sacrificed, simulations and live-fire test data demonstrate that the capability to control or shape the pattern density of expelled metal fragments over the prescribed solid angle improves the overall lethality of the warhead and reduces collateral damage because the case is pulverized and the expelled metal fragments from the assembly are better confined to the prescribed solid angle.

Figure 3:
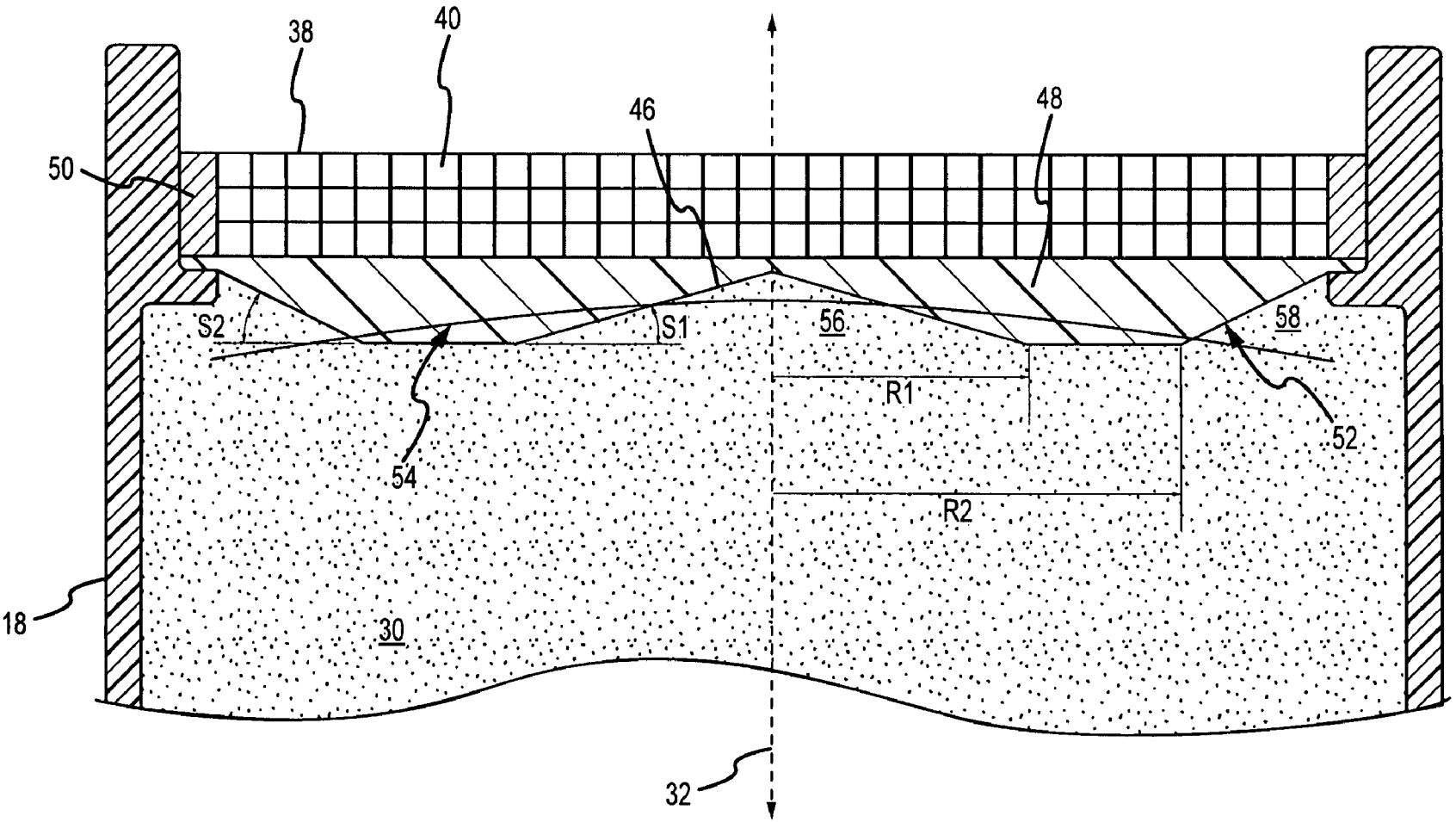
FIG. 3 is a more detailed view of the aft section of the warhead.

An exemplary embodiment of the pattern shaper 48 and conformal interface between explosive 30 and the pattern shaper is illustrated in FIG. 3. This particular design is for a single-point detonation to achieve approximately uniform density over a prescribed solid-angle. The aft surface 52 of the pattern conforms to the fore surface 46 of the explosive. This non-planar interface progressively slows the propagation velocity of a pressure wave 54 with increasing radius from body axis 32 up to a radius R1 and progressively increases the propagation velocity of the pressure wave with increasing radius from a radius R2>R1 so that the number of expelled fragments per unit area is approximately uniform over a prescribed solid angle upon detonation of the explosive. To achieve the desired shaping of the relative velocities in the different spatial regions of the wave across the warhead, fore surface 46 of the explosive has a convex conical shape 56 around the body axis with radius R1 and a slope S1 and has a convex annular shape 58 around the periphery starting at radius R2>R1 with a slope S2 to the inner wall of case 18. The fore surface 46 is flat in an annular region of R2-R1. The conformal aft surface of the pattern shaper has a concave conical shape with radius R1 and slope S2 and a concave annular shape around the periphery starting at radius R2 with slope S2.

Pressure wave 54 travels relatively faster in the convex center and peripheral regions 56 and 58, respectively, because explosive 30 continues to detonate. Once the wave reaches the pattern shaper it slows down. How much the wave slows down is dictated by the shock impedance of the shaper material which is a function of the material's density and the speed of sound in the material and the thickness of the pattern shaper. Lower density materials such as composites are generally preferred because they absorb less energy. However, higher density materials can have a smaller volume leaving more space for explosive. The range of materials suitable for the shaper includes fiber reinforced composites, thermoplastic (resin, polymer), nylon, rubber, stereolithographic (SL) materials, structural foams, and metals. The only qualification is that it be either castable or machinable.

Figure 4:
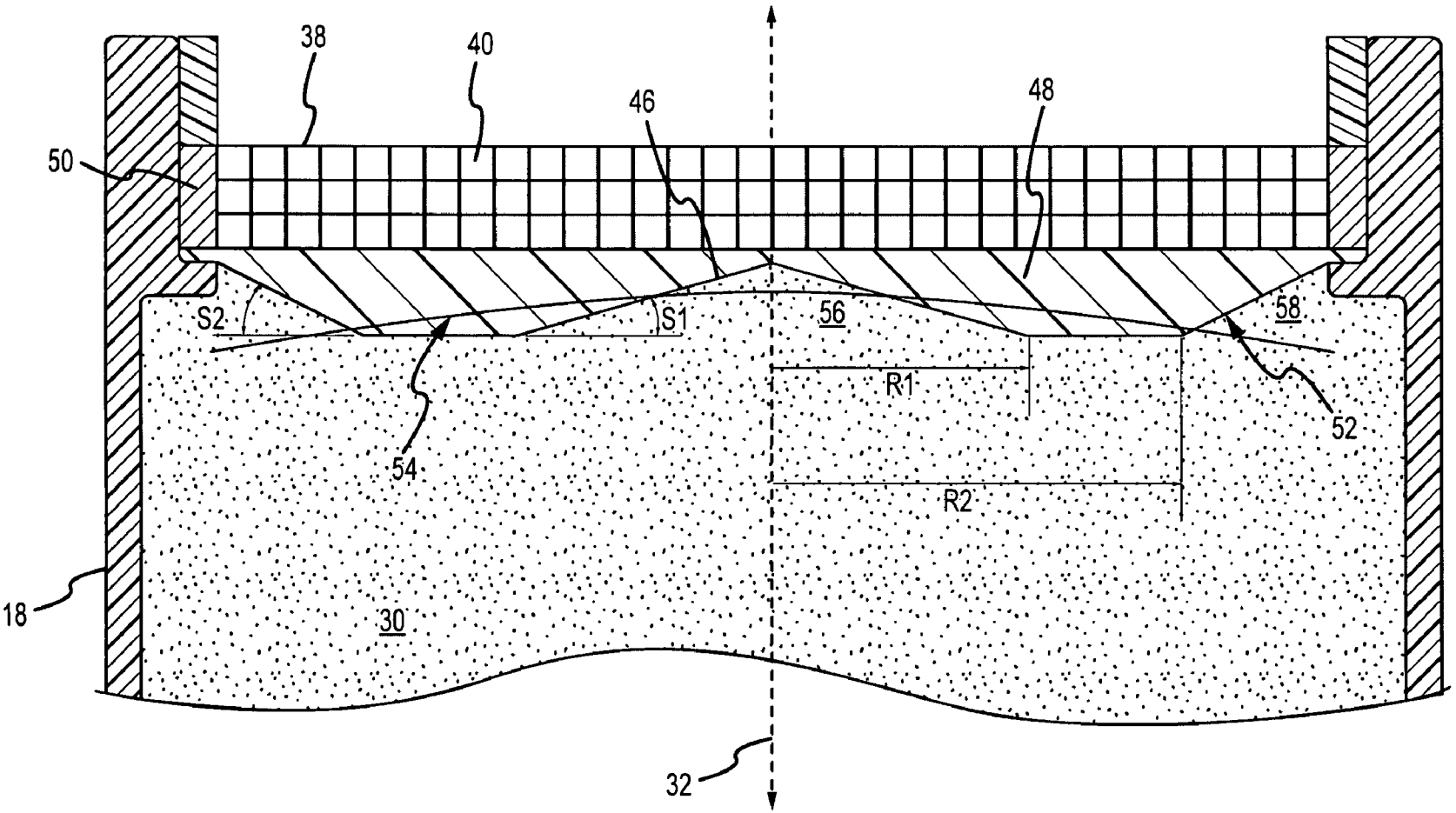
FIG. 4 is a more detailed view of an alternate embodiment of the aft section of the warhead.

Retaining ring 50 placed around the periphery and at least coextensive with fragmentation assembly 38 provides confinement albeit for a few milliseconds that emphasizes the expelled fragments axial velocity over their radial velocity. The design of the retaining ring and the other annular region 58 are jointly optimized to bring the tails of the distribution of the expelled fragments in to the prescribed solid angle. As shown in FIG. 3, the ring is coextensive with the fragmentation assembly. As shown in FIG. 4, the ring is extended to a length of approximately twice that of the fragmentation assembly to provide additional confinement. The former configuration may, for example, be used with cube fragments whereas the latter may, for example, be used with spherical fragments that tend to have a larger radial velocity component.

The design of the pattern shaper depicted in FIGS. 3 and 4 is only exemplary for a particular detonation configuration, desired pattern density, casing material and pattern shaper material. In general the pattern shaper design space starts with a warhead weight and volume budget. The minimum fragment mass and velocity for a single fragment are determined based on the lethality requirement. The total number of fragments required to cover the required area to overcome composite system error is determined. Then the maximum thickness of the fragmentation assembly (composed of many fragments) is determined, first from the Gurney approximation, and then more accurately by computer modeling. This calculation also yields the required high explosive height and weight. In parallel, the maximum thickness of shaper of a certain density that can be inserted between the explosive and the fragment assembly is determined. This allowable volume and mass of the shaper determines the amount of energy that could be lost. The energy being absorbed by the shaper is trivial compared to the portion that is transmitted through the shaper. The magnitude of transmission is dependent on the shaper material properties, specifically density and speed of sound. The product of density and speed of sound is called acoustic impedance (or shock impedance if the wave velocity exceeds the speed of the sound in that material which it does in the warhead).

With this energy budget, we can select the right class of material that will meet not only the mass requirement but the right shock impedance. It is usually preferable to use a light density material, provided that the material meets the impedance and mass requirement. An advantage is that this class of material will not damage the fragments. It is conceivable to select a material with higher density, for example a light metal, again meeting the impedance and mass requirement. But because of its strength and ductility, it unfortunately changes the fragment fly-out characteristics. The shaper, then, becomes coupled to the fragment disk, making the shaper geometry design more complicated.

The radius and slope R1/S1 and R2/S2 of the convex conical region and the convex annular region are determined based on test data and/or computer simulation of the warhead without the pattern shaper and the desired distribution of the pattern fragment density (fragments per unit and number of fragments) at a certain target distance and solid angle. If test data is available, the computer model is calibrated to match it. Near one-to-one mapping can be made from the initial fragment position to the target location. These individual mappings are sorted and turned into the mapping between the fragment annulus and the on-target annulus. The required mapping yields the magnitude of the radial trajectory corrections that must be made from the baseline warhead. These trajectory corrections are essentially the fragment velocity vector corrections. The fragment velocity vector corrections can be realized by contouring of the explosive and fragment interface. But since we desire to have flat fragment disk surface (assembly, cost), we introduce an interface material in the form of the pattern shaper that will effectively act as a surrogate to change the wave front. (R1, S1) & (R2, S2) are determined based on the desired corrections (magnitude and direction), for each annulus. But because there is an immediate effect from the adjacent annuli, computer modeling must be used to arrive at the desired (R1, S1), (R2, S2), and, if needed, (R3, S3), etc.

Figure 5:
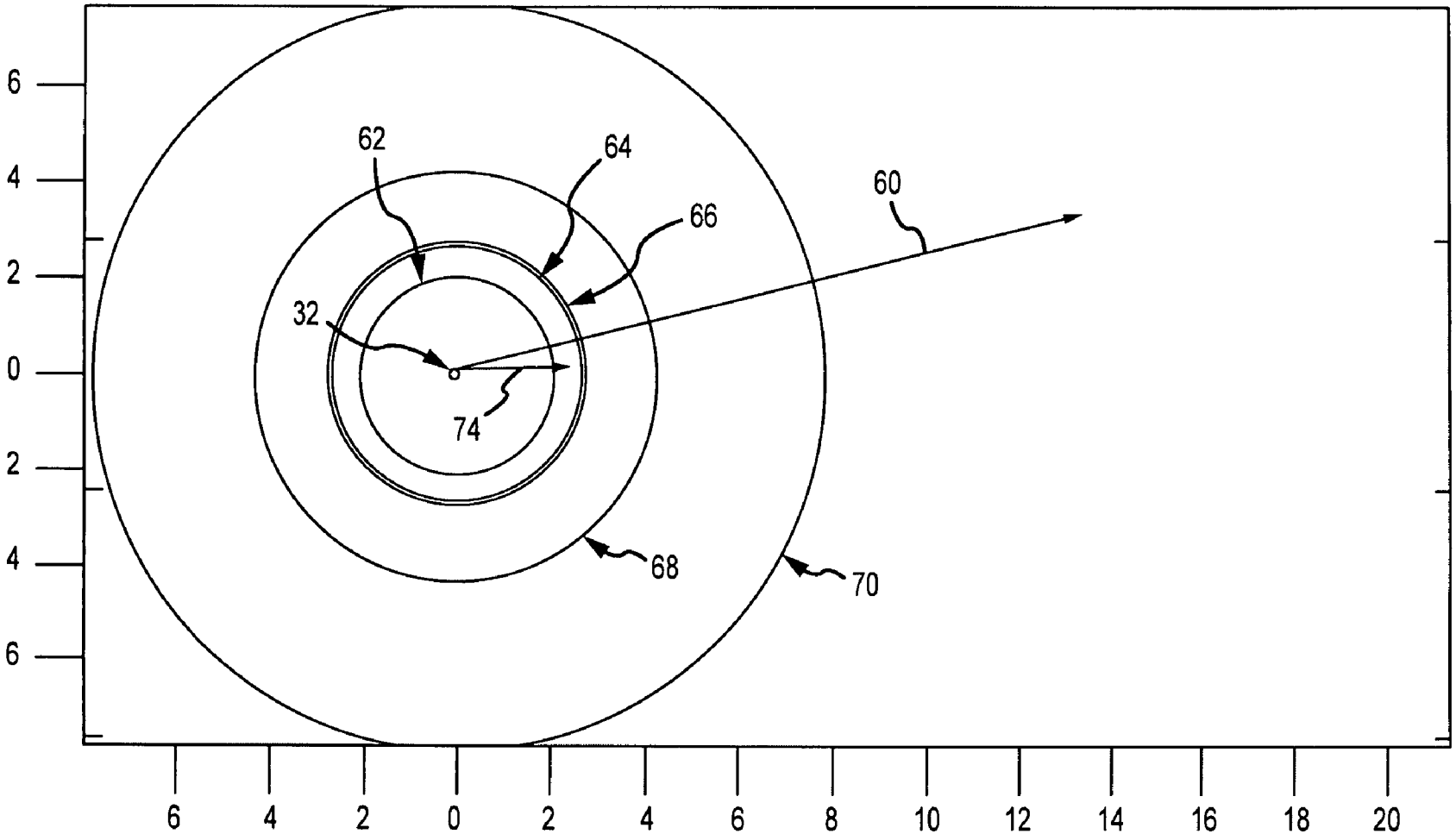
FIG. 5 is a diagram illustrating the blast effects of both the gas blast of the high explosive and the pulverized case.
Figure 6:
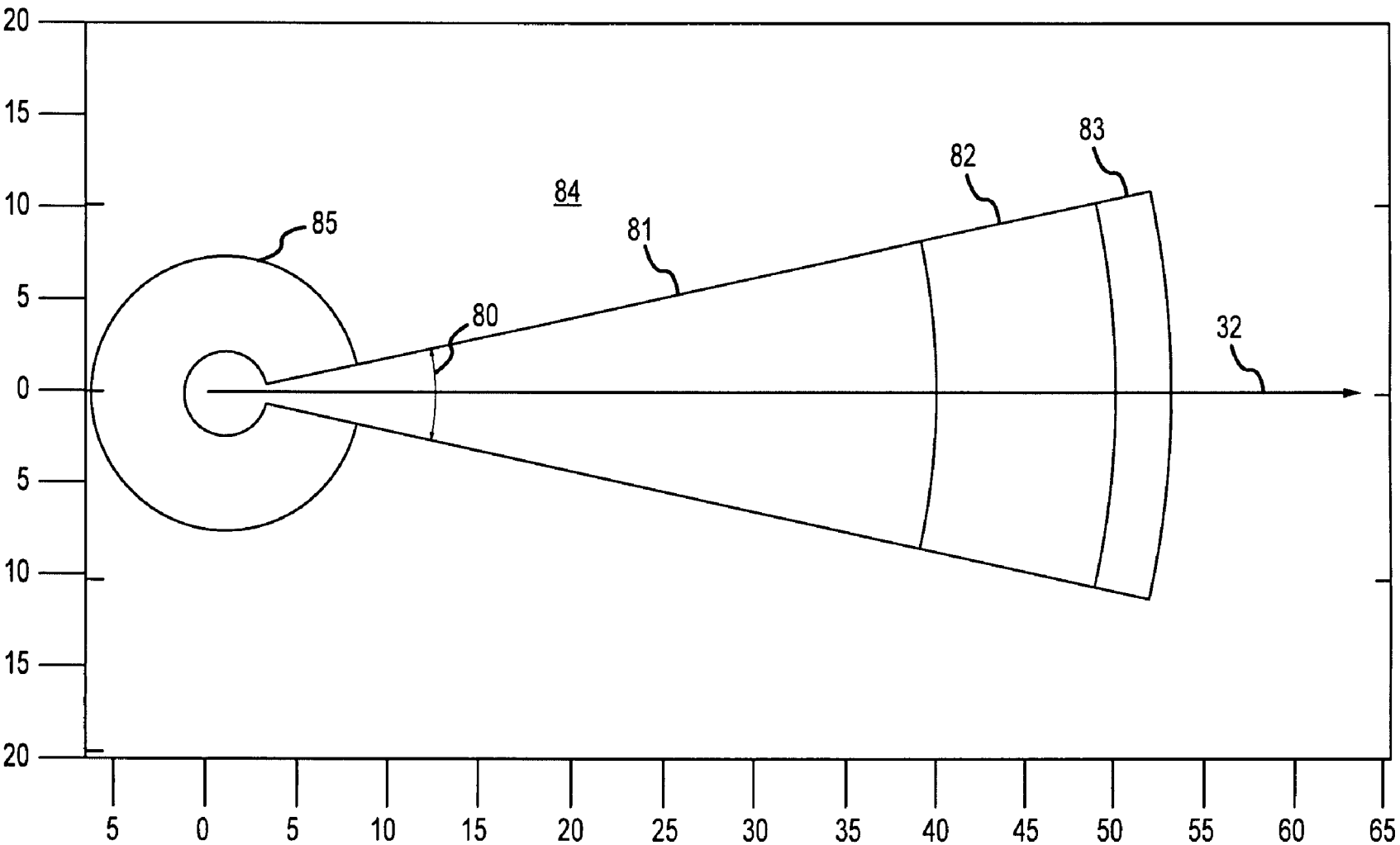
FIG. 6 is a diagram illustrating the blast effects of the patterned shaped fragments.
Figures 7A, 7B, 7C, 7D, 8A, 8B, 8C, 8D:
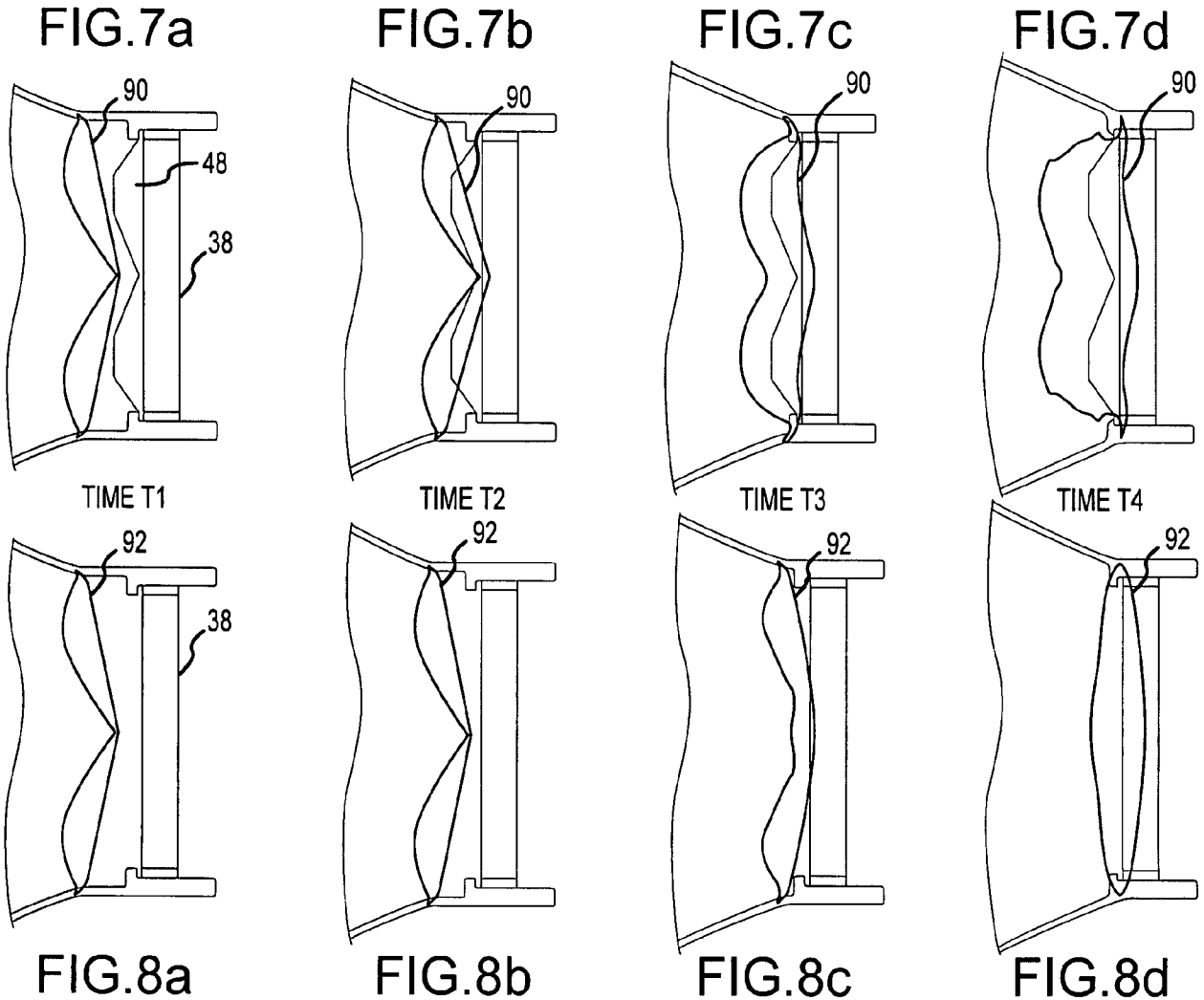
FIGS. 7*a*-7*d* are diagrams illustrating the propagation of the pressure wave through a conventional fragmentation assembly.
FIGS. 8*a*-8*d* are diagrams illustrating the propagation of the pressure wave through the pattern shaper and fragmentation assembly in accordance with the present invention.

The radial blast patterns from the detonation of the explosive and pulverized case and the forward axial blast pattern from the detonation of the fragmentation assembly are depicted in FIGS. 5 and 6. Looking down the body axis 32, detonation of the explosive produces a gas blast that creates a pressure wave 60 that emanates radially from the body axis and decreases with distance. The effects of the gas blast on humans are well-known and standardized in the industry to facilitate warhead design. For this particular warhead, the 99% fatal threshold 62 occurs at approximately 2 meters (any point inside the threshold is 99% fatal), the 50% fatal threshold 64 at approximately 2.5 meters, the 1% fatal threshold (lethality threshold) 66 at approximately 2.7 meters (any point inside the threshold is considered fatal as defined), lung damage threshold 68 at approximately 4 meters, the eardrum rupture threshold 70 at approximately 8 meters and beyond that there is little personal effect 72 due to the pressure wave caused by the detonation of the explosive. Of course these distances depend on the amount of explosive in the warhead. In a conventional warhead, the detonation of the steel casing would have a fatal threshold extending beyond the threshold at which the gas blast itself has little personal effect. The detonation of the steel casing greatly increases the risk of collateral damage without significantly improving the desired lethality of the warhead. In the current warhead, the pulverized case has lethality threshold 74 no greater than the lethality threshold 66 of the gas blast. Consequently, the risk of collateral damage is minimized.

Looking along the body axis 32 from above, detonation of the explosive expels metal fragments forward with a prescribed solid angle 80 about the body axis. The uniform pattern, resulting from a properly designed shaper, thus increases the probability of a hit in the prescribed volume. Each fragment is designed to be lethal such that given a hit, it will provide a kill. The probability of a kill Pk being greater than 99% (81) to a radius of approximately 40 meters over the prescribed angle, greater than 50% (82) to a radius of approximately 50 meters and greater than 1% (lethality threshold 83) to a radius of approximately 53 meters and beyond that less than 1%. Also, the Pk 84 outside the prescribed solid angle (except for within the gas blast radius 85) is less than 1%.

Propagation of pressure waves 90 and 92 at times T1, T2, T3 and T4 through two warheads one with and one without the pattern shaper 48 is illustrated in FIGS. 7*a*-7*d* and 8*a*-8*d*, respectively. For clarity only the leading portion of the wave is shown. At time T1, pressure wave front 90 arrives at pattern shaper 48. At time T2 both pressure wave fronts arrive at the bottom of the fragmentation assembly 38. The portion of the wave front 90 that passed through the annular region of shaper between the body axis and (R2, S2) has slowed sufficiently and resulted in greater curvature near the middle. The rate of slowing is a function of shaper's shock impedance (product of the density and the speed of the sound) and its thickness at each location. Though the energy loss is also proportional and because of its volume in real application is very small compared to the main charge, the loss is tolerable and the gain in pattern trajectory control is far greater. The wave front 92 has not changed shape. At times T3 and then T4 the front of the waves 90 and 92 are within the fragment assembly. The portion of wave 92 bound by the body axis and (R1, S1) has already greater curvature than the one without the shaper. This will create greater outer (radial) velocity component in the fragments of this region, allowing them to disperse more outwardly to flatten the number of fragments per unit area. The wave front 92 of the warhead without the shaper has a constant lower curvature, with much smaller radial velocity component. The portion of the wave 90 between (R1, S1) & (R2, S2) has flattened, and will launch the fragments with their intended axial velocity component. The remaining wave front 90, between (R2, S2) and the retaining ring 50, has actually achieved a negative curvature. The fragments in this region will have less outward/radial component than they would without the shaper. This will help bring in the peripheral fragments and reduce or eliminate the tails of the distribution.

Figure 9A:
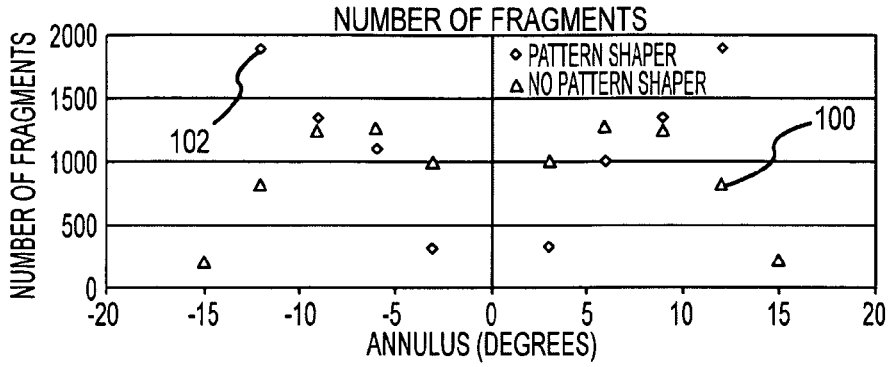
FIGS. 9*a* and 9*b* and 10*a* and 10*b* are diagrams plotting the number of expelled fragments and number of expelled fragments per area over solid angle for a conventional fragmentation assembly and for a pattern shaped fragmentation assembly in accordance with the present invention.
Figure 9B:
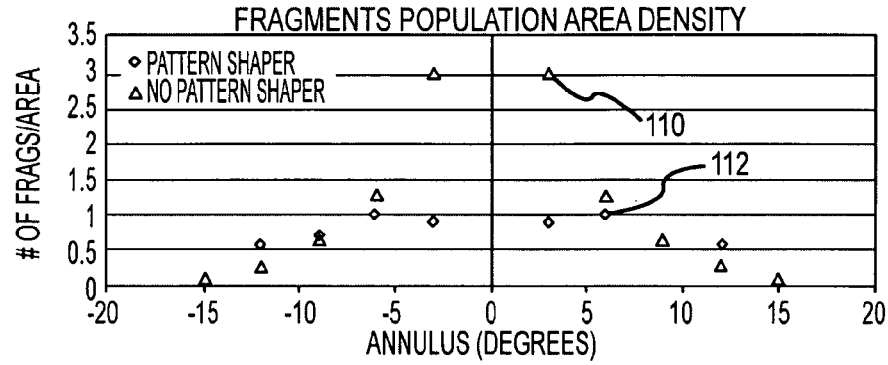
Figure 10A:
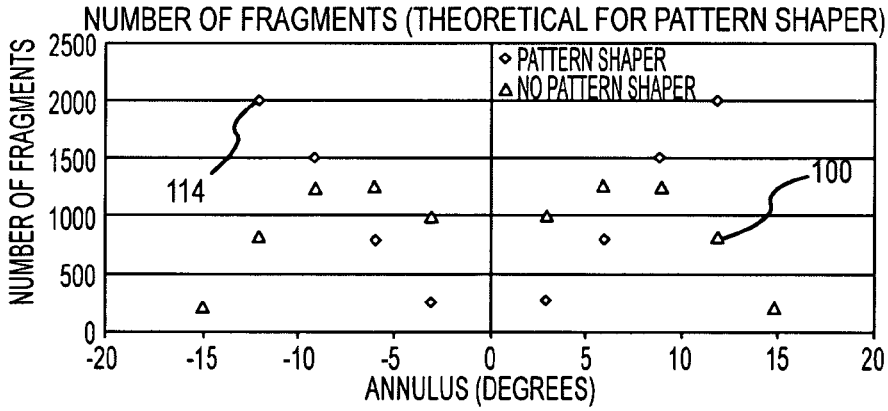
Figure 10B:
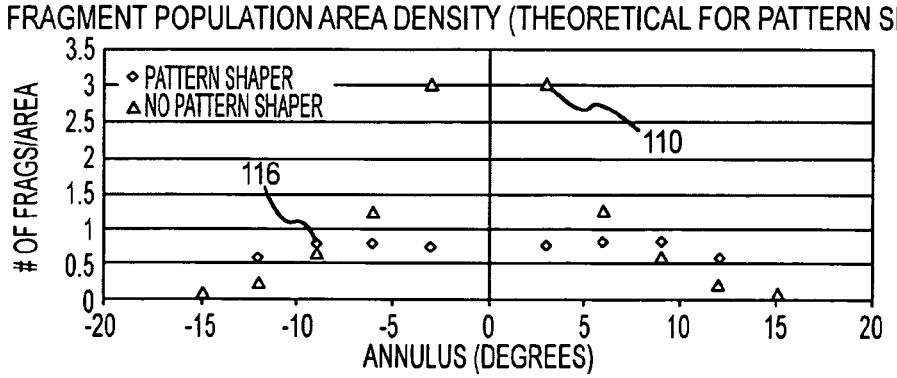

Actual and simulated results of the pattern density produced by the two warheads one with and one without the pattern shaper are shown in FIGS. 9*a* and 9*b* and 10*a* and 10*b*, respectively. As shown in FIG. 9*a*, for the warhead without the pattern shaper the number of fragments 100 falls off with increasing angle from the body-axis yet extends beyond the prescribed solid angle of plus/minus 12 degrees. The warhead with the pattern shaper effectively shifts fragments from small angles to larger angles within the prescribed solid-angle. Fragments 102 illustrate the results for a preliminary design of the pattern shaper. The impact of pattern shaping is shown in FIG. 9*b* that plots the number of fragments per unit area across the prescribed solid-angle. As expected, the warhead without the pattern shaper has a maximum density 110 in a small annulus around the body-axis that falls off rapidly over the prescribed solid-angle with tails outside the angle. By comparison, the warhead with the pattern shaper has a density 112 for the initial design that is approximately uniform over the prescribed angle. FIGS. 10*a* and 10*b* show the number of fragments 114 and the fragment density 116 (simulated) for an optimized pattern shaper design against the actual data without the shaper. The optimized design exhibits less variation in pattern density over the prescribed solid angle. A variation of less than 25% and preferably less than 15% over the prescribed solid-angle being considered approximately uniform. Without the pattern shaper the density may vary by more than 85% over the solid angle.

Figure 11C:
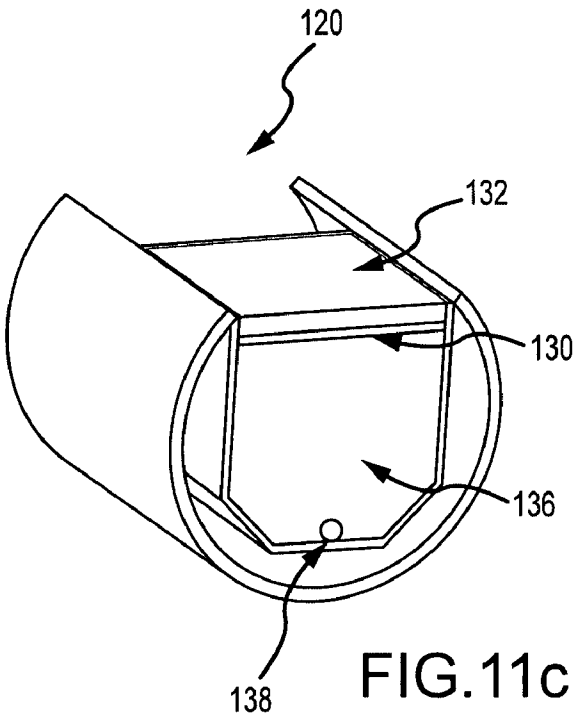
FIGS. 11*a*-11*c* are diagrams of an alternative side-firing warhead.
Figure 11B:
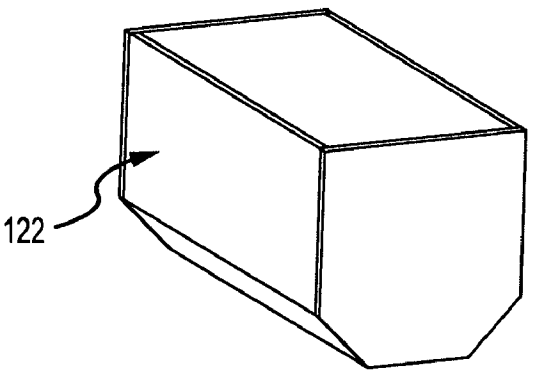
Figure 11A:
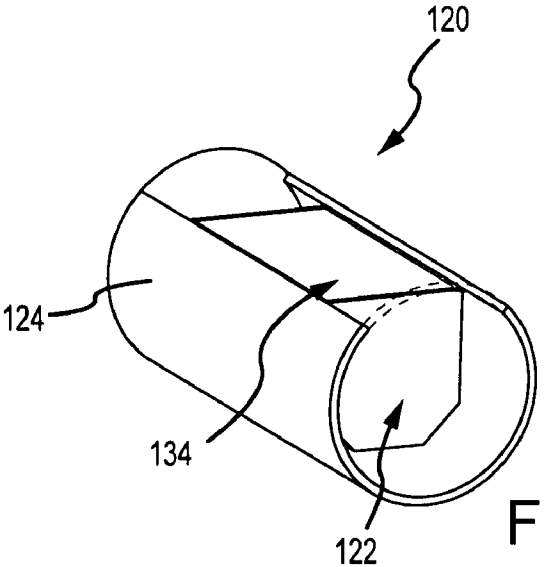

Although a forward-firing warhead configuration is the most typical, the principles of the invention, the pulverized case material and the pattern shaper can also be applied to a side-firing warhead 120 as illustrated in FIGS. 11*a*-11*c*. In this exemplary embodiment, a side-firing warhead insert 122 is slid into an external casing 124 having an opening 126 to the side of the body axis. The external case 124 and an internal casing 128 for the insert are suitably formed from a fiber reinforced composite, engineered wood, thermoplastic (resin, polymer), or foam that is pulverized upon detonation. A pattern shaper 130, fragmentation assembly 132 and cover 134 (of similar material to the casings) are placed over the explosive 136 in opening 126. The booster 138 and safe and arm assembly (not shown) are placed at the opposite end, in the center, of the fragmentation assembly to initiate the detonation that propagates through explosive towards the opening to expel metal fragments sideways (radially) from the warhead.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A controlled fragmentation warhead, comprising:

a case having and inner surface and an opening, said case formed of a material that is pulverized upon detonation;

an explosive in said case that is in conformal contact with the inner surface of the case eliminating metal fragments thrown radially from the warhead;

a fragmentation assembly in said opening, said fragmentation having an aft surface, means for detonating said explosive to produce a pressure wave across the aft surface of the fragmentation assembly that expels metal fragments from the fragmentation assembly, and a pattern shaper between said explosive and said fragmentation assembly, said pattern shaper having a fore surface in conformal contact across the entire aft surface of the fragmentation assembly to shape the front of the pressure wave as it propagates through the pattern shaper and across the aft surface of the fragmentation assembly to shape a pattern density of the expelled metal fragments.

2. The warhead of claim 1, wherein the fore surface of the pattern shaper and the aft surface of the fragmentation assembly are planar.

3. The warhead of claim 1, wherein the pulverized case material has a lethality radius no greater than the lethality radius due to the gas blast of the explosive.

4. The warhead of claim 1, wherein the case is pulverized upon detonation with a mass efficiency near 0%.

5. The warhead of claim 1, wherein the metal fragments expelled from the fragmentation assembly have a mass efficiency of at least 70%.

6. The warhead of claim 1, further comprising:

a metal retaining ring around the periphery and at least coextensive with said fragmentation assembly.

7. The warhead of claim 1, wherein no explosive is positioned between the fore surface of the pattern shaper and the aft surface of the fragmentation assembly.

8. The warhead of claim 1, wherein the facing surfaces of the explosive and pattern shaper are non-planar and conformal to change the relative velocities of the propagating pressure wave across the surface of the fragmentation assembly to shape the pattern density of expelled metal fragments.

9. The warhead of claim 8, wherein the surface of the explosive has a convex shape around a body axis through the center of the case, said pattern shaper getting progressively thicker with increasing radius from said body axis to slow the propagation velocity of the pressure wave.

10. The warhead of claim 9, wherein beyond a radius R1 the pattern shaper gets progressively thinner to increase the propagation velocity of the pressure wave.

11. The warhead of claim 1, wherein the pattern shaper is a lower density material than the explosive.

12. A controlled fragmentation warhead, comprising:

a case having a forward opening about a body axis, said case formed of a material that is pulverized upon detonation;

an explosive in said case, said explosive having a non-planar fore surface around the body axis at said opening, wherein no fragmentation assembly is positioned between the explosive and the case eliminating metal fragments thrown radially from the warhead;

a fragmentation assembly in said forward opening, said fragmentation assembly having an aft surface, a metal retaining ring around the periphery and at least coextensive with said fragmentation assembly;

means for detonating said explosive to produce a pressure wave that propagates along the body axis and across the aft surface of the fragmentation assembly to expel metal fragments forward from the fragmentation assembly; and a pattern shaper between said explosive and said fragmentation assembly, said pattern shaper having a surface conformal with the non-planar shape of said explosive surface and conformal with the aft surface of the fragmentation assembly, said pattern shaper getting progressively thicker to slow the propagation velocity of the pressure wave with increasing radius from said body axis up to a radius R1 and progressively thinner to increase the propagation velocity of the pressure wave with increasing radius from a radius R2>R1 so that the number of expelled fragments per unit area is approximately uniform over a prescribed solid angle forward about the body axis upon detonation of the explosive, wherein no explosive is positioned between the pattern shaper and said fragmentation assembly.

13. The warhead of claim 12, wherein said pulverized case material having a mass efficiency no greater than 1% with a lethality radius no greater than the lethality radius due to the gas blast of the explosive, said expelled metal fragments having a mass efficiency of at least 70% with a lethality radius over a prescribed solid angle greater than the lethality radius of the gas blast.

14. The warhead of claim 12, wherein the surface of the explosive has a convex conical shape around a body axis through the center of the case with radius R1 and a slope S1 and has a convex annular shape around the periphery starting at radius R2>R1 with a slope S2.

15. A controlled fragmentation warhead, comprising:

a case having an inner surface and an opening;

an explosive in said case;

a fragmentation assembly in said opening;

means for detonating said explosive to produce a pressure wave across an aft surface of the fragmentation assembly that expels metal fragments from the fragmentation assembly;

a pattern shaper between and in conformal contact with a fore surface of said explosive and in conformal contact across the aft surface of said fragmentation assembly that shapes the front of the pressure wave as it propagates through the pattern shaper and is incident across the aft surface of the fragmentation assembly to shape a pattern density of the expelled metal fragment.

16. The warhead of claim 15, wherein the fore surface of the pattern shaper and the aft surface of the fragmentation assembly are planar.

17. The warhead of claim 15, wherein the pattern shaper is in conformal contact across the entire aft surface of the fragmentation assembly.

18. The warhead of claim 15, wherein said pattern shaper gets progressively thicker with increasing radius from a body axis through the center of the case to slow the propagation velocity of the pressure wave.

19. A controlled fragmentation warhead, comprising:

a case having an opening;

an explosive in said case;

a fragmentation assembly in said opening, means for detonating the explosive to produce a pressure wave across a surface of the fragmentation assembly that expels metal fragments from the fragmentation assembly, and a pattern shaper between said explosive and said fragmentation assembly to shape the front of the pressure wave as it propagates through the pattern shaper across the surface of the fragmentation assembly to control a pattern density of expelled metal fragments, wherein no explosive is positioned between the pattern shaper and said fragmentation assembly.

20. The warhead of claim 19, wherein said pattern shaper gets progressively thicker to slow the propagation velocity of the pressure wavefront with increasing radius from an axis through the center of the case up to a radius R1 and progressively thinner to increase the propagation velocity of the wavefront with increasing radius from a radius R2>R1 so that the number of expelled fragments per unit area is approximately uniform over a prescribed solid angle upon detonation of the explosive.

21. The warhead of claim 19, wherein the pattern shaper is in conformal contact across the entire aft surface of the fragmentation assembly.

22. The warhead of claim 19, wherein the pattern shaper is a lower density material than the explosive.

* * * * *